US008696076B2

(12) United States Patent
Karg

(10) Patent No.: US 8,696,076 B2
(45) Date of Patent: Apr. 15, 2014

(54) FURNITURE ITEM HAVING A FURNITURE BODY AND A FOLDING FLAP

(71) Applicant: Julius Blum GmbH, Hochst (AT)

(72) Inventor: David Karg, Bregenz (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/973,139

(22) Filed: Aug. 22, 2013

(65) Prior Publication Data

US 2013/0334944 A1 Dec. 19, 2013

Related U.S. Application Data

(63) Continuation of application No. PCT/AT2012/000074, filed on Mar. 22, 2012.

(30) Foreign Application Priority Data

Apr. 29, 2011 (AT) ..... 601/2011

(51) Int. Cl.
*A47B 88/00* (2006.01)

(52) U.S. Cl.
USPC ..... 312/323; 312/325; 312/319.5; 312/109; 160/210

(58) Field of Classification Search
USPC ..... 312/322–323, 325, 319.5–319.8, 109, 312/110, 138.1, 139, 139.1, 204, 297; 49/254, 255, 257, 258, 128, 197, 199, 49/201, 203; 160/210, 213, 218
See application file for complete search history.

(56) References Cited

U.S. PATENT DOCUMENTS

| | | | | |
|---|---|---|---|---|
| 1,198,521 | A * | 9/1916 | Brubaker | 49/203 |
| 2,334,749 | A * | 11/1943 | Burr | 160/192 |
| 2,393,052 | A * | 1/1946 | Mehard | 160/189 |
| 2,886,394 | A | 5/1959 | Snyder | |
| 4,637,446 | A * | 1/1987 | McQueen et al. | 160/207 |
| 5,020,580 | A * | 6/1991 | Dalman | 160/213 |
| 6,296,337 | B1 * | 10/2001 | Kawanabe | 312/319.2 |
| 6,877,830 | B2 | 4/2005 | Salice | |
| 7,219,711 | B2 * | 5/2007 | Keller et al. | 160/213 |
| 8,162,027 | B2 * | 4/2012 | Archer | 160/207 |
| 8,414,093 | B2 * | 4/2013 | Moran | 312/248 |
| 2003/0160551 | A1 * | 8/2003 | Beyer et al. | 312/323 |
| 2005/0264144 | A1 | 12/2005 | Verbeek et al. | |

(Continued)

FOREIGN PATENT DOCUMENTS

| | | |
|---|---|---|
| DE | 93 01 627 | 6/1993 |
| DE | 201 00 662 | 5/2001 |

(Continued)

OTHER PUBLICATIONS

International Search Report (ISR) issued Jul. 20, 2012 in International (PCT) Application No. PCT/AT2012/000074.

*Primary Examiner* — Hanh V Tran
(74) *Attorney, Agent, or Firm* — Wenderoth, Lind & Ponack, L.L.P.

(57) ABSTRACT

The invention relates to a furniture item having a furniture body and a folding flap, wherein the folding flap comprises at least three sub-flaps arranged one above the other. A first sub-flap is pivotally mounted relative to the furniture body, a second sub-flap is pivotally mounted with respect to the first sub-flap and a third sub-flap is pivotally mounted relative to the second sub-flap.

25 Claims, 5 Drawing Sheets

(56) References Cited

U.S. PATENT DOCUMENTS

Figure 1:
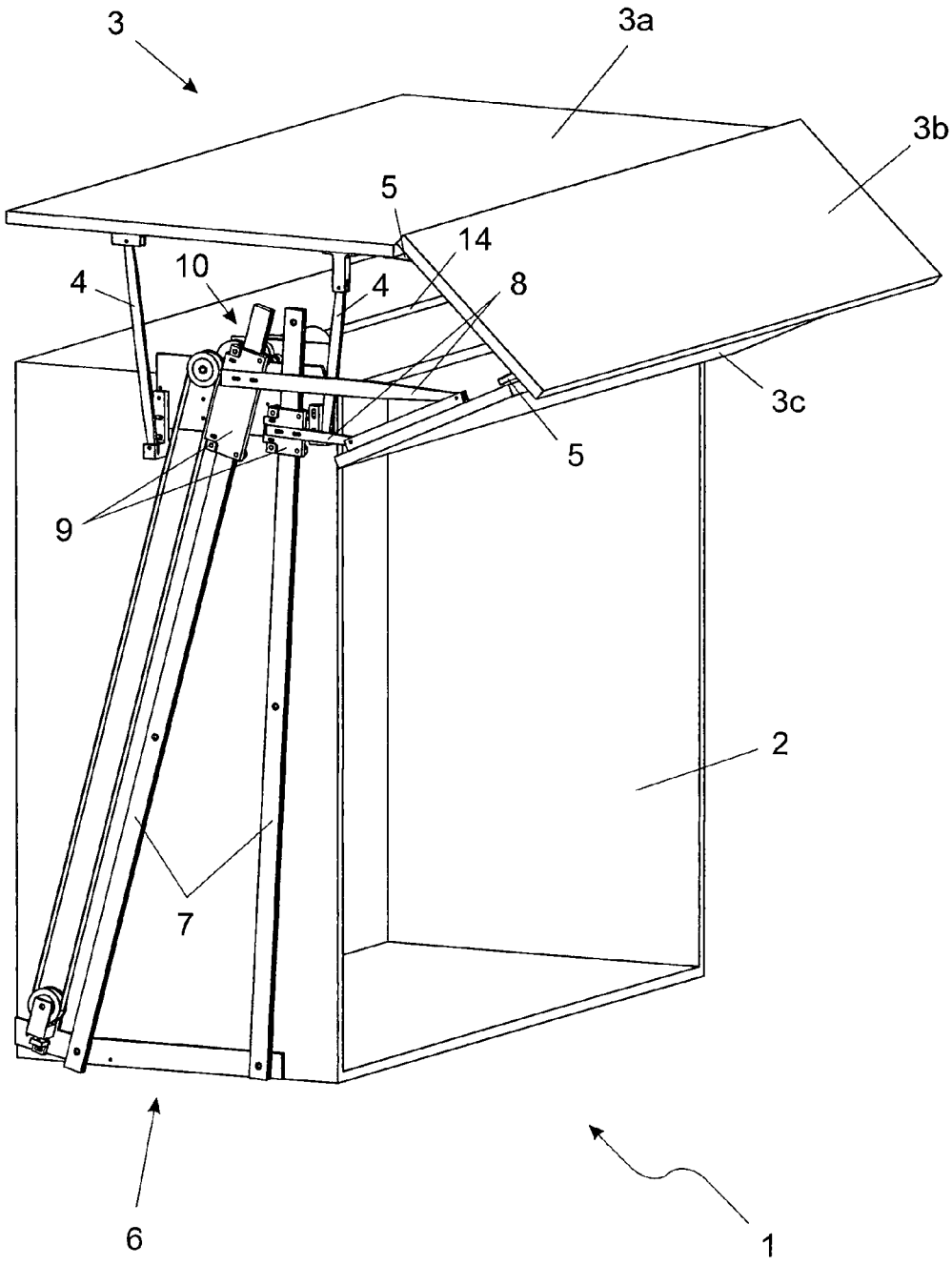

| | | | | |
|---|---|---|---|---|
| 2006/0103276 | A1* | 5/2006 | Salice | 312/323 |
| 2008/0054771 | A1* | 3/2008 | Brunnmayr | 312/323 |
| 2008/0086947 | A1* | 4/2008 | Crown | 49/199 |
| 2008/0265727 | A1* | 10/2008 | Kohlman et al. | 312/319.1 |
| 2009/0261696 | A1 | 10/2009 | Hollenstein et al. | |
| 2010/0050529 | A1* | 3/2010 | Manser | 49/199 |
| 2011/0036015 | A1 | 2/2011 | Archer | |

FOREIGN PATENT DOCUMENTS

| | | | | |
|---|---|---|---|---|
| DE | 201 04 988 | | 10/2001 | |
| EP | 1 713 999 | | 12/2009 | |
| FR | 1 492 864 | | 8/1967 | |
| FR | 2 219 615 | | 9/1974 | |
| JP | 04319308 A | * | 11/1992 | A47B 77/06 |

* cited by examiner

FURNITURE ITEM HAVING A FURNITURE BODY AND A FOLDING FLAP

The invention concerns an article of furniture having a furniture carcass and a folding flap.

It is known to use folding flaps for closing off articles of furniture, instead of doors. Folding flaps are distinguished in that they take up little space in the opened condition of being folded together, and as a result increase for example the free moving space in constricted kitchens.

In certain areas of use in particular upwardly movable folding flaps can be advantageous. In this connection mention may be made for example of upper cupboards in kitchens. EP 1 713 999 B1 and DE 201 00 662 U1 disclose such upwardly movable folding flaps. What is characteristic in that respect is that those folding flaps which are part of the state of the art comprise two flap portions.

A disadvantage is that those folding flaps are not suitable for covering articles of furniture which exceed a given size, or for example even entire regions in a kitchen. That is due in particular to the fact that the two flap portions are very bulky under those conditions and the two-leaf folding flap in the folded-together condition projects very far into the room. That casts doubt on the actual advantage of a folding flap. Irrespective of that the weight of the two flap portions is so great that the folding flap can only still be opened by applying a great deal of force. The force required for that purpose can no longer be applied by the lifting devices which are usually employed in relation to smaller folding flaps.

The object of the present invention is to avoid the above-described disadvantages and to provide a folding flap which is improved over the state of the art and which can be universally employed and which is suitable in particular for covering large articles of furniture or for example entire regions in a kitchen.

According to the invention that object is attained in that the folding flap has at least three flap portions arranged one above the other, wherein a first flap portion is mounted pivotably relative to the furniture carcass, a second flap portion is mounted pivotably relative to the first flap portion and a third flap portion is mounted pivotably relative to the second flap portion.

A basic idea of the invention is therefore that of constructing a folding flap comprising at least three flap portions.

In an advantageous embodiment of the invention the fronts of the at least three flap portions are in one plane when the folding flap is closed.

In the completely opened condition a particularly space-saving arrangement of the three flap portions is distinguished in that the first flap portion which is mounted pivotably relative to the furniture carcass is arranged substantially horizontally and/or over the furniture carcass. Advantageously then the front of the second flap portion is at an obtuse angle $\alpha$ relative to the front of the first flap portion and the front of the third flap portion is at an acute angle $\beta$ relative to the front of the second flap portion. Generally an angle is referred to as 'obtuse' if the value of the angle is greater than 90° and less than 180°, and an angle is referred to as 'acute' if the value of the angle is greater than 0° and less than 90°. Preferably the angle $\alpha$ is of a value of between 125° and 145° and the value of the angle $\beta$ is of a value of between 60° and 75°.

As the folding flap according to the invention is intended in particular to cover particularly large articles of furniture or for example entire regions of a kitchen it is advantageous if the width of the folding flap is greater than 1 meter and/or the heights of the at least three flap portions are greater than 0.25 meter.

When the first flap portion is arranged in the fully opened condition of the folding flap substantially over the furniture carcass, it can then be advantageous if the first flap portion is higher than the other two flap portions and for example is of a height of greater than 0.5 meter. In that way it is possible for as large a part as possible of the folding flap (in the completely opened condition) to be 'stowed' in a highly space-saving fashion. In a preferred embodiment the height of the first flap portion is also greater than the depth of the furniture carcass.

The feature that the first flap portion is mounted pivotably relative to the furniture carcass can be implemented technically for example by the flap portion being connected to the furniture carcass by way of articulated levers. The relative pivotability of the second flap portion in relation to the first flap portion and/or the third flap portion in relation to the second flap portion can be achieved by those flap portions being connected to each other by hinges.

To simplify opening and closing of the folding flap it can be provided that at least one of the flap portions, preferably the third flap portion, is movable by way of an actuating device. The remaining flap portions then passively follow the flap portion which is movable by way of the actuating device. Such an actuating device can be technically implemented for example by means of two guide paths, wherein the flap portion which is movable by way of the actuating device is connected to the guide paths for example by way of, respectively, a lever and a guide device. In the simplest case the guide paths are linear. Accordingly the guide devices are then linear guides. If now the guide paths are arranged at an angle $\gamma$ relative to each other, wherein $\gamma$ is advantageously of a value between 5° and 20° and is preferably about 12°, and if articulated levers are used as the levers, by way of which the flap portion which is movable by way of the actuating device is connected to the guide paths, a linear displacement of the two linear guides along the two guide paths in the course of the opening or closing process simultaneously also leads to a continuous pivotal movement of that flap portion.

In cases in which the folding flap takes on very large dimensions and as a result becomes very heavy, the opening or closing process can be facilitated by at least one of said guide devices, by way of which the flap portion which is movable by way of the actuating device is connected to the guide paths, is drivable by way of a drive. The drive used can be for example a belt drive.

In the simplest case the above-described actuating device is arranged laterally on the furniture carcass.

It can be provided that installations, preferably washing sinks, extractor hoods and/or lighting arrangements are disposed in the space which is closable by the folding flap.

It is further appropriate for the article of furniture according to the invention with the folding flap to be integrated into a built-in article of furniture, in particular for a living room wall or kitchen wall. Such a built-in article of furniture can for example include a plurality of drawers and/or doors arranged for example beneath and/or beside the folding flap. From an aesthetic point of view it may be advantageous if the front of the closed folding flap is in one plane with the front sides of the drawers and/or doors.

Figure 2:
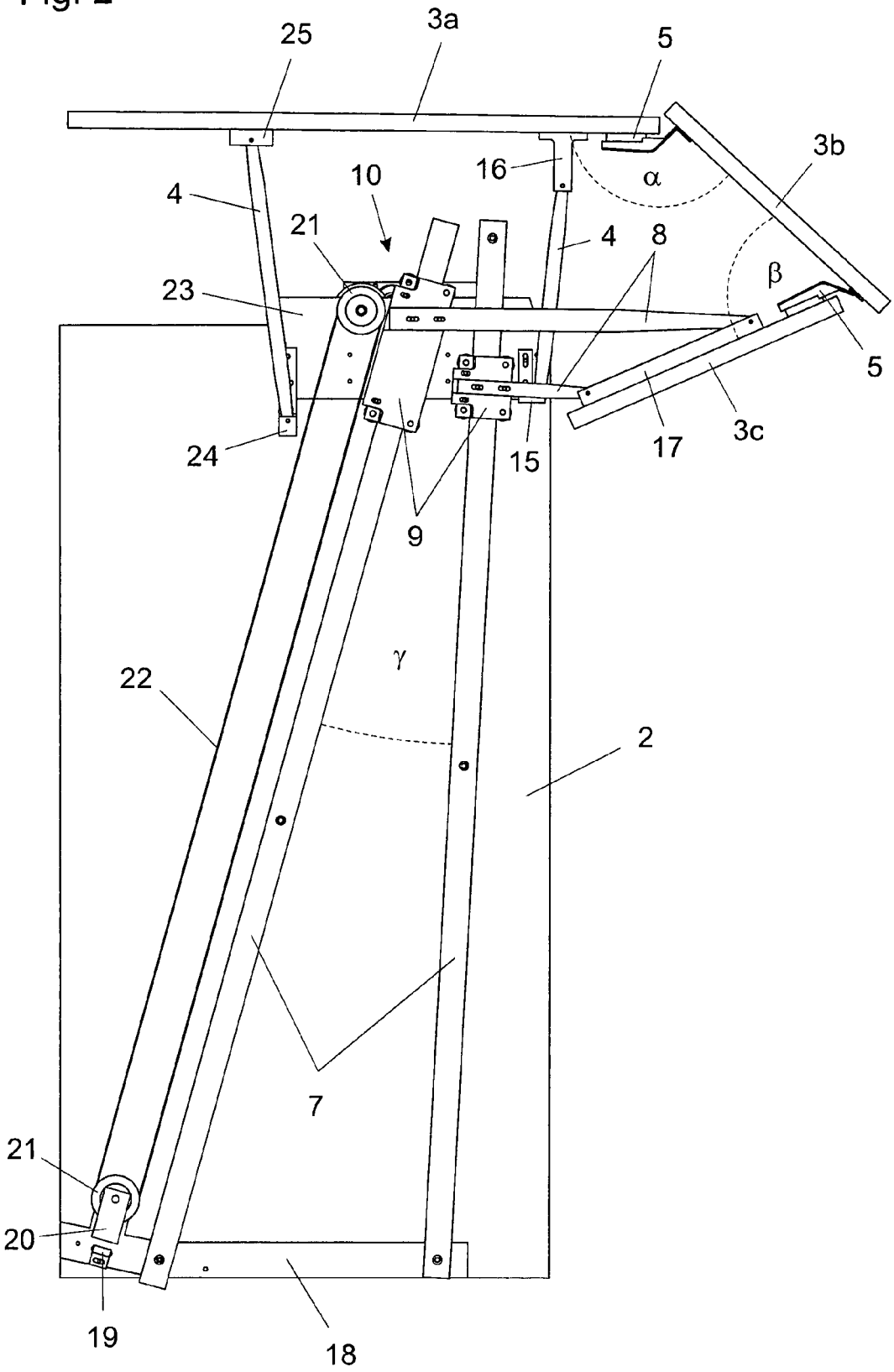
Figure 3:
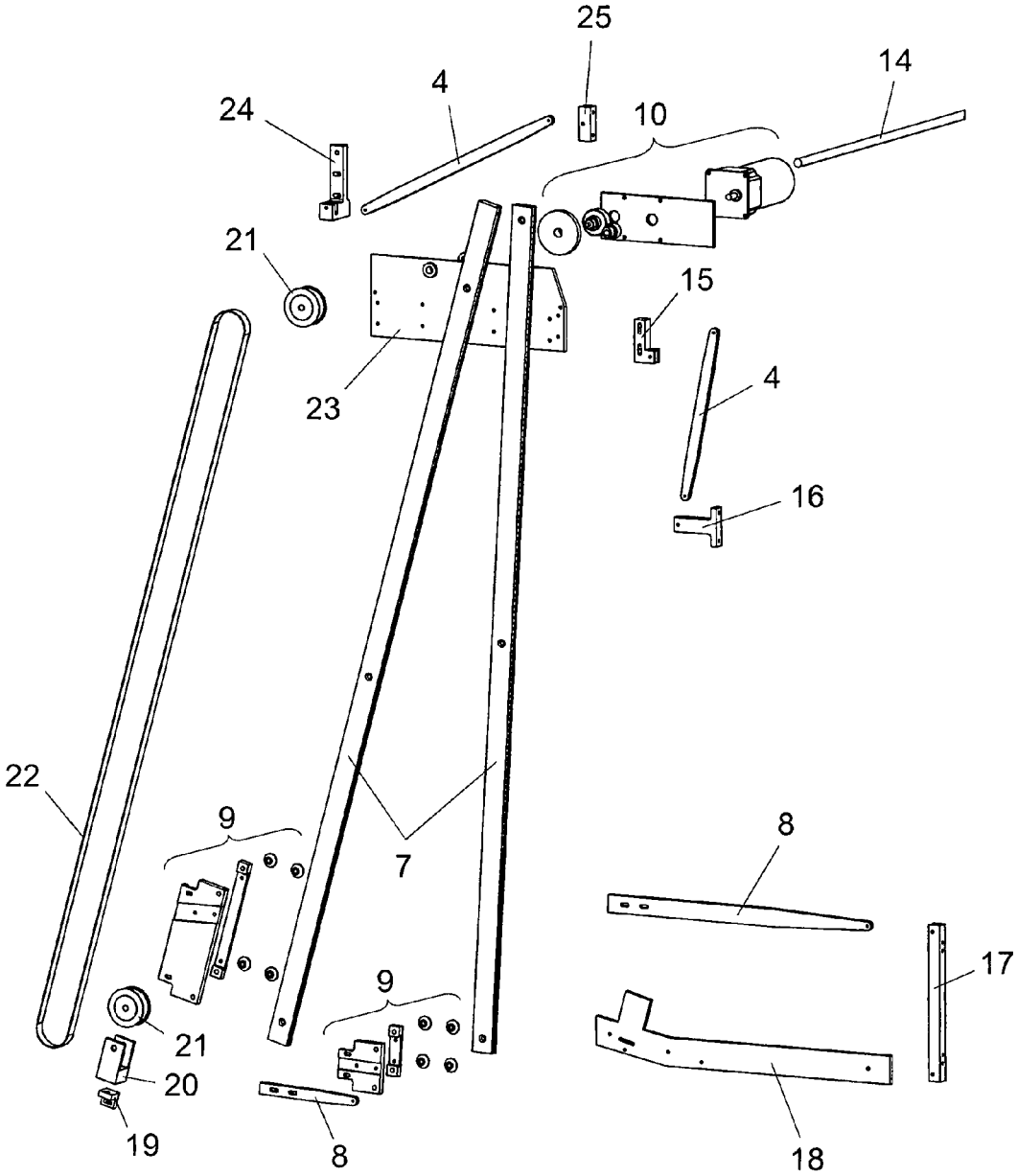
Figure 4A:
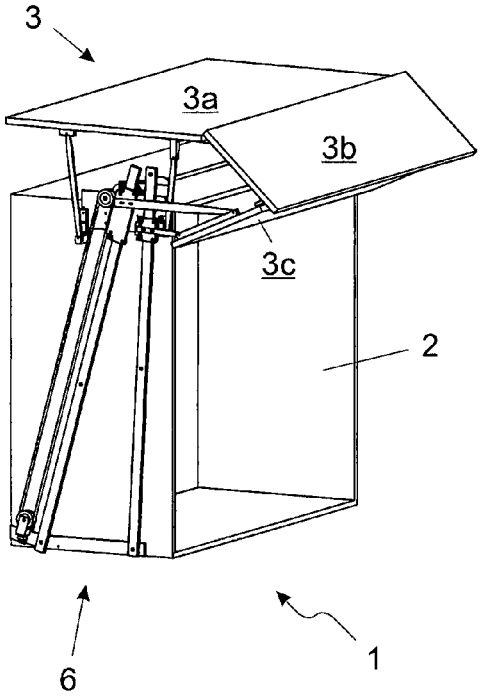
Figure 4B:
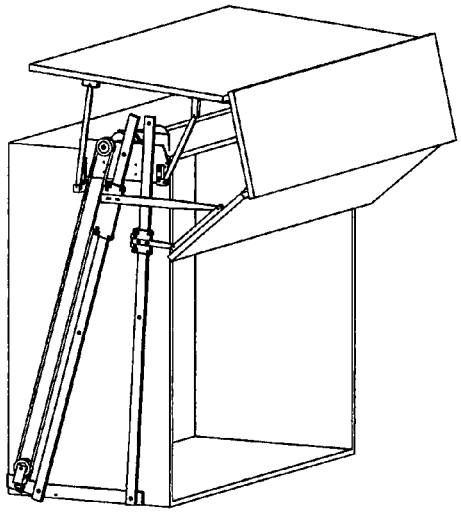
Figure 4C:
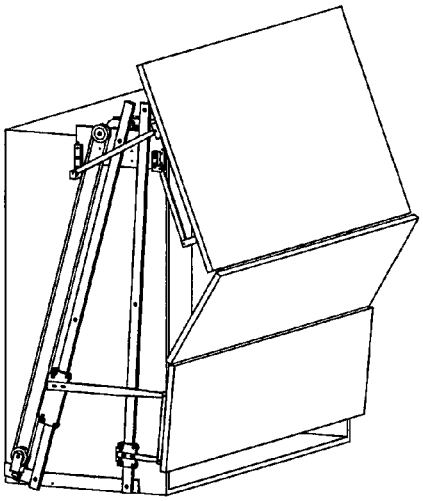
Figure 4D:
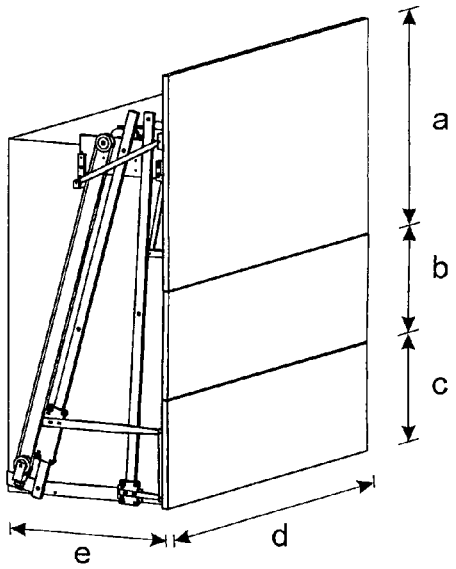
Figure 5A:
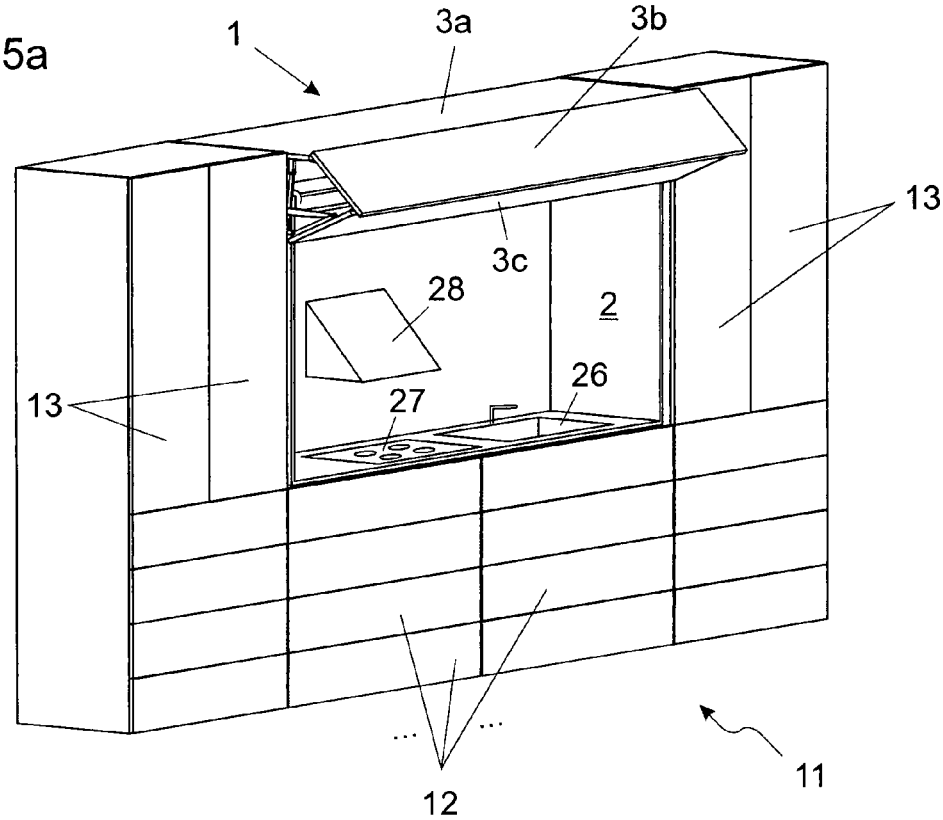
Figure 5B:
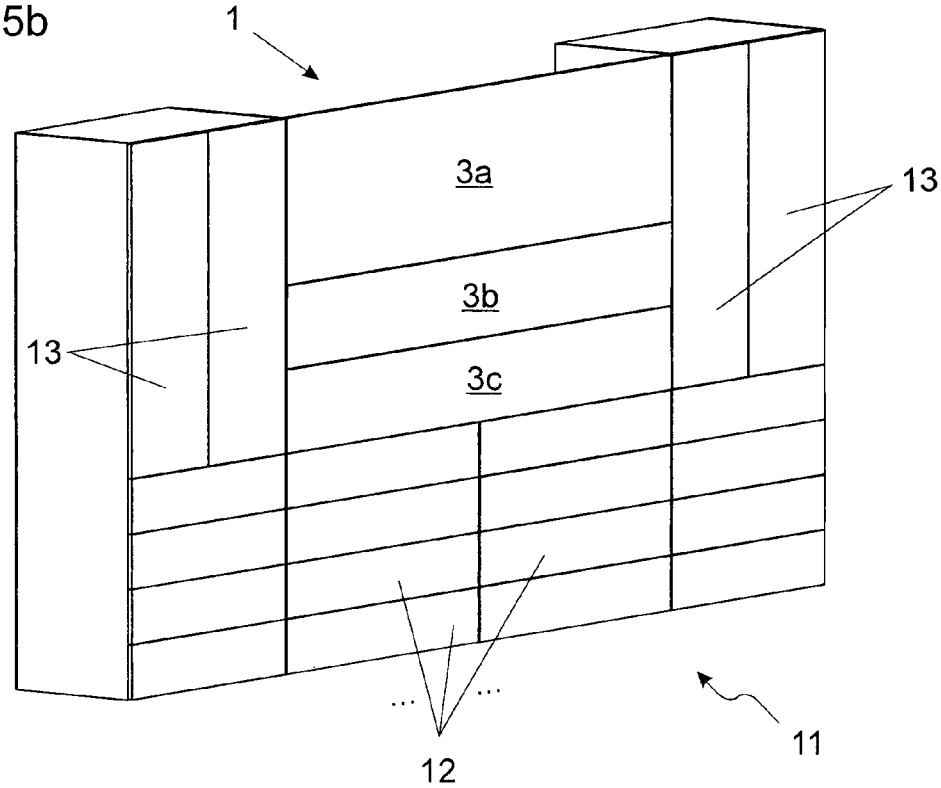

Further details and advantages of the present invention are described in greater detail hereinafter by means of the specific description with reference to the embodiments by way of example illustrated in the drawings in which:

FIG. 1 shows a perspective view of a preferred embodiment of the article of furniture according to the invention with a completely opened folding flap, FIG. 2 shows a side view of the preferred embodiment of FIG. 1, FIG. 3 shows an exploded view of the components constituting the actuating device in the preferred embodiment, FIGS. 4*a* through 4*d* show a sequence of four views of the preferred embodiment to illustrate an opening or closing process of the folding flap, and FIGS. 5*a* and 5*b* show two perspective views of a built-in article of furniture for a kitchen wall, in which the article of furniture according to the invention is integrated; on the one hand with the folding flap completely opened and on the other hand with the folding flap closed.

In the preferred embodiment shown in FIG. 1 the article of furniture 1 according to the invention includes a furniture carcass 2 and a folding flap 3, the folding flap 3 having three flap portions 3*a*, 3*b* and 3*c* arranged one above the other. The first flap portion 3*a* is connected to the furniture carcass 2 by way of articulated levers 4 and is thus mounted pivotably relative to the furniture carcass. The drawing shows two of the four articulated levers 4, by way of which that flap portion 3*a* is connected to the furniture carcass 2. The other two articulated levers 4 are fixed to the opposite side wall of the furniture carcass 2. The second flap portion 3*b* is connected to the first flap portion 3*a* by way of two hinges 5 and can thus be pivoted relative to that first flap portion 3*a*. The third flap portion 3*c* is connected to the second flap portion 3*b* in the same way. The third flap portion 3*c* is movable by way of an actuating device 6. That actuating device 6 includes two linear guide paths 7, wherein arranged on the guide paths 7 are respective linear guides 9 connected to the flap portion 3*c* by way of a respective articulated lever 8. The two guide paths 7 are arranged relative to each other at an angle γ. The left-hand one of the two linear guides 9 can be moved by way of a belt drive 10. As a further consequence, that provides that the flap portion 3*c* is movable along the furniture carcass 2 upwardly or in the reverse direction. Due to the fact that the two guide paths 7 are at an angle γ relative to each other the flap portion 3*c* is tilted at the same time during that movement. The other two flap portions 3*a* and 3*b* passively follow that translatory or tilting movement. It should be noted that the described actuating device 6 is arranged on both sides of the furniture carcass 2. The drawing however shows only one of the two actuating devices 6 as the second actuating device 6 is concealed by a side wall of the furniture carcass 2. Synchronisation of the two actuating devices 6 is effected by way of a synchronisation rod 14.

FIG. 1 shows the folding flap 3 in the completely opened condition. In this condition the first flap portion 3*a* is arranged entirely above the furniture carcass 2. The front of the second flap portion 3*b* is at an obtuse angle α relative to the front of the first flap portion 3*a* while the front of the third flap portion 3*c* is at an acute angle β relative to the front of the second flap portion 3*b*. In the preferred embodiment the height a of the first flap portion 3*a* is greater than the depth e of the furniture carcass 2 and thus projects somewhat beyond the furniture carcass 2 in the completely opened position of the folding flap.

FIG. 2 shows a side view of the preferred embodiment shown as a perspective view in FIG. 1. The folding flap 3 is again completely opened. It can be clearly seen from this view that the first flap portion 3*a* is arranged horizontally in that position, the front of the second flap portion 3*b* is at an obtuse angle α of about 135° relative to the front of the first flap portion 3*a* and the front of the third flap portion 3*c* is at an acute angle β of about 65° relative to the front of the second flap portion 3*b*. The two guide paths 7 are arranged relative to each other at an angle γ of about 12°. Besides the components already referred to in the description of FIG. 1, attention is also directed to:

- the mounting portions 15 and 16, as well as 24 and 25, by means of which the articulated levers 4 are fixed to the flap portion 3*a* and the furniture carcass 2 respectively,
- the rail 17 which is fixed to the flap portion 3*c* and the two ends of which are hingedly connected to the two articulated levers 8,
- the fixing elements 18, 19 and 23, by means of which the actuating device 6 is substantially mounted to the furniture carcass 2, and
- the workpiece 20, the two rollers 21 and the endless belt 22 which are substantially necessary to implement the belt drive.

In that case the belt 22 is connected to the left-hand linear guide 9. A movement of the belt 22 therefore results in a translatory movement of that linear guide 9 which in turn also moves the flap portion 3*c* by way of the joint lever 8 fixed thereto.

FIG. 3 shows an exploded view of the essential individual components necessary for technical implementation of the actuating drive in the preferred embodiment. It can be clearly seen that the drive unit 10 for the belt drive (from left to right) includes a plurality of gears, a mounting plate and an electric motor. The two linear guides 9 each consist of two mounting components which in the assembled condition embrace the guide paths 7 in a clip-like fashion and to which there are respectively mounted two wheels for ongoing movement with as little friction as possible of the linear guides 9 on the guide paths 7.

The sequence shown in FIGS. 4*a* through 4*d* of four images of the preferred embodiment serve to illustrate an opening or closing process of the folding flap 3. FIG. 4 involves the same view as that shown in FIG. 1. Therefore only the essential components are denoted by references in this Figure. They representatively apply to the other three images therein.

Starting from the completely opened condition of the folding flap 3 shown in FIG. 4*a* FIGS. 4*b* and 4*c* show two intermediate positions of the folding flap 3 while FIG. 4*d* shows the folding flap 3 in the closed condition. It can be clearly seen that a movement of the belt 22 leads to a linear movement of the two linear guides 9 and thus a translatory or tilting movement of the flap portion 3*c*. The flap portions 3*b* and 3*a* are passively moved therewith. The height of the three flap portions 3*a*, 3*b* and 3*c* are denoted by a, b and c respectively in FIG. 4*d* (being representative for all Figures). The width of the folding flap 3 is denoted by reference d while the depth of the furniture carcass 2 is denoted by e. As can be seen, the heights b and c of the two flap portions 3*b* and 3*c* are the same. The first flap portion 3*a* is about twice as great as the other two flap portions 3*b* and 3*c* and at the same time greater than the depth e of the furniture carcass 2. Absolute values of the preferred embodiment are: b=c=0.35 m; a=0.7 m; d=1.7 m and e=0.5 m.

FIGS. 5*a* and 5*b* show two perspective views of a built-in article of furniture 11 for a kitchen wall, in which the article of furniture 1 according to the invention is integrated. In this case FIG. 5*a* shows the folding flap 3*a* in the completely opened condition whereas the folding flap 3 is closed in FIG. 5*b*. The built-in article of furniture 11, besides the article of furniture 1 according to the invention, includes four cupboard doors 13, of which two are arranged to the right beside the folding flap 3 and two to the left respectively, and a plurality of drawers 12 arranged beneath the folding flap 3. As already stated in the introductory part of the description the folding flap 3 can be used to cover entire regions of a kitchen. That region can include for example a washing sink 26, a hob 27 or an extractor hood 28. It can also be seen that for example still further shelves are disposed within the article of furniture 1 according to the invention.

The invention claimed is:

1. An article of furniture comprising a furniture carcass and a folding flap, characterised in that the folding flap has at least three flap portions arranged one above the other, wherein a first flap portion is mounted pivotably relative to the furniture carcass, a second flap portion is mounted pivotably relative to the first flap portion and a third flap portion is mounted pivotably relative to the second flap portion, wherein the front of the second flap portion has relative to the front of the first flap portion an obtuse angle of between 125° to 145°, the front of the third flap portion has relative to the front of the second flap portion an acute angle of between 60° and 75°, and the first flap portion is arranged substantially over the furniture carcass in the completely opened condition.

2. The article of furniture according to claim 1 characterised in that the fronts of the at least three flap portions are disposed in one plane in the closed condition.

3. The article of furniture according to claim 1 characterised in that the front of the first flap portion is arranged substantially horizontally in the completely opened condition.

4. The article of furniture according to claim 1 characterised in that the width of the folding flap is greater than 1 meter.

5. The article of furniture according to claim 1 characterised in that the heights of the at least three flap portions are greater than 0.25 meters.

6. The article of furniture according to claim 1 characterised in that the height of the first flap portion is greater than 0.5 meter.

7. The article of furniture according to claim 1 characterised in that the height of the first flap portion is greater than the depth of the furniture carcass.

8. The article of furniture according to claim 1 characterised in that the first flap portion is connected to the furniture carcass by way of articulated levers.

9. The article of furniture according to claim 1 characterised in that the first flap portion and the second flap portion and/or the second flap portion and the third flap portion are connected to each other by way of hinges.

10. An article of furniture according to claim 1 characterised in that at least one of the flap portions, is movable by way of an actuating device.

11. The article of furniture according to claim 10 characterised in that the actuating device includes at least two guide paths and the flap portion which is movable by way of the actuating device is connected to the guide paths.

12. The article of furniture according to claim 11 characterised in that the flap portion which is movable by way of the actuating device is connected to the guide paths by way of, respectively, at least one lever and a guide device.

13. The article of furniture according to claim 12 characterised in that the lever is a articulated lever.

14. The article of furniture according to claim 12 characterised in that the guide device is a linear guide.

15. The article of furniture according to claim 11 characterised in that the guide paths are linear.

16. The article of furniture according to claim 15 characterised in that the guide paths are arranged at an angle (γ)relative to each other.

17. The article of furniture according to claim 16 characterised in that the angle (γ) is between 5° and 20°.

18. The article of furniture according to claim 12 characterised in that the guide device is drivable by way of a drive.

19. The article of furniture according to claim 18 characterised in that the drive is a belt drive.

20. The article of furniture according to claim 10 characterised in that the actuating device is arranged laterally on the furniture carcass.

21. The article of furniture according to claim 1 characterised in that arranged in the space closable by the folding flap are installations, a washing sink, hob plates, extractor hoods and/or lighting means.

22. A built-in article of furniture, in particular for a living room wall or kitchen wall including drawers and/or doors, characterised in that an article of furniture according to claim 1 is integrated in the built-in article of furniture.

23. The built-in article of furniture according to claim 22 characterised in that the front of the closed folding flap is in one plane with the front sides of the drawers and/or doors.

24. The built-in article of furniture according to claim 22 characterised in that the drawers and/or doors are arranged beneath the article of furniture.

25. The built-in article of furniture according to claim 22 characterised in that the drawers and/or doors are arranged beside the article of furniture.

* * * * *